US010287049B2

(12) United States Patent
Beutler

(10) Patent No.: US 10,287,049 B2
(45) Date of Patent: May 14, 2019

(54) BAG OPENER COMPONENT FOR PLASTIC BAG DISPENSER

(71) Applicant: Arthur Julius Beutler, Greendale, WI (US)

(72) Inventor: Arthur Julius Beutler, Greendale, WI (US)

( * ) Notice: Subject to any disclaimer, the term of this patent is extended or adjusted under 35 U.S.C. 154(b) by 359 days.

(21) Appl. No.: 14/999,640

(22) Filed: Jun. 8, 2016

(65) Prior Publication Data

US 2017/0029154 A1 Feb. 2, 2017

Related U.S. Application Data

(63) Continuation-in-part of application No. 14/756,067, filed on Jul. 27, 2015, now Pat. No. 10,160,617.

(51) Int. Cl.

| | |
|---|---|
| ***B65B 67/12*** | (2006.01) |
| ***B65H 35/10*** | (2006.01) |
| *A47F 9/04* | (2006.01) |

(52) U.S. Cl.

CPC ..... *B65B 67/1266* (2013.01); *B65H 35/10* (2013.01); *A47F 2009/044* (2013.01); *B65B 2067/1272* (2013.01); *B65H 2701/191* (2013.01)

(58) Field of Classification Search

CPC ..... B65B 67/1266; B65B 2067/1272; B65H 35/10; B65H 2701/191; F16B 21/06; F16B 21/065; B29C 65/562; A47F 2009/191

See application file for complete search history.

(56) References Cited

U.S. PATENT DOCUMENTS

| | | | | |
|---|---|---|---|---|
| 3,481,112 | A * | 12/1969 | Bourgeois | B65B 67/1266 220/495.07 |
| 3,655,036 | A * | 4/1972 | Corelli | B65B 67/1266 206/526 |
| 3,740,918 | A * | 6/1973 | Meyer | B60R 13/04 156/91 |
| 4,093,138 | A * | 6/1978 | Shafer | B65H 35/0006 225/66 |
| 4,281,785 | A * | 8/1981 | Brooks | B25C 5/02 156/311 |
| 4,409,707 | A * | 10/1983 | Muraishi | B60R 13/0206 24/625 |
| 4,793,539 | A * | 12/1988 | Haenni | A47F 9/042 221/63 |
| 4,904,092 | A | 2/1990 | Campbell | |
| 4,930,385 | A * | 6/1990 | Wilfong, Jr. | A47F 9/042 221/63 |
| 5,135,146 | A | 8/1992 | Simhaee | |
| 5,195,221 | A * | 3/1993 | Kanamaru | A44B 19/26 24/419 |
| 5,261,585 | A | 11/1993 | Simhaee | |
| 5,433,363 | A | 7/1995 | Simhaee | |
| 5,480,084 | A * | 1/1996 | Daniels | B26F 3/002 225/106 |
| 5,556,019 | A | 9/1996 | Morris | |
| 5,573,168 | A | 11/1996 | Kannankeril | |

(Continued)

*Primary Examiner* — Alexander M Valvis
*Assistant Examiner* — Eduardo R Ferrero

(57) ABSTRACT

A bag opener is presented as an accessory component for bag roll dispensers, which is suitable for multiple-ply bags (such as "star sealed" bags) that are dispensed from a continuous roll and allows bags to be dispensed to the user in a partially opened state.

6 Claims, 8 Drawing Sheets

(56) References Cited

U.S. PATENT DOCUMENTS 5,706,993 A * 1/1998 DeMatteis ..... B26F 3/002 225/106
5,752,666 A 5/1998 Simhaee
5,921,390 A 7/1999 Simhaee
5,934,535 A * 8/1999 Kannankeril ..... A47F 13/085 225/106
6,135,281 A 10/2000 Simhaee
6,374,570 B1 * 4/2002 McKague, Jr. ..... B29C 65/56 52/762
6,406,074 B1 * 6/2002 Mahaney ..... E05B 65/0089 292/256.6
6,450,380 B1 * 9/2002 Simhaee ..... A47F 9/042 221/26
6,488,242 B1 * 12/2002 Barriere ..... B65B 67/1233 248/100
6,932,257 B1 * 8/2005 Guerrero ..... B65H 35/10 225/39
7,270,256 B2 9/2007 Daniels
7,424,963 B2 9/2008 Daniels
7,530,526 B1 * 5/2009 Powers ..... A47K 10/38 242/422.5
8,979,367 B2 3/2015 Tan
9,199,820 B2 * 12/2015 Tseng ..... B65H 35/10
9,206,007 B2 * 12/2015 Helseth ..... B65H 16/005
10,045,669 B2 * 8/2018 Morand ..... A47K 10/38
10,160,617 B2 * 12/2018 Beutler ..... B65H 35/10
2003/0129040 A1 * 7/2003 Arisaka ..... F16B 19/1081 411/41
2004/0007607 A1 * 1/2004 Daniels ..... A47F 9/042 225/93
2005/0220560 A1 * 10/2005 Shinozaki ..... F16B 19/1081 411/37
2007/0039991 A1 * 2/2007 Alberts ..... B65D 33/002 225/46
2009/0178247 A1 * 7/2009 Jalbert ..... F16B 19/1081 24/459
2009/0261106 A1 * 10/2009 Stelmach ..... B65F 1/06 220/495.11
2011/0073629 A1 * 3/2011 Tseng ..... B26F 3/02 225/51
2012/0024884 A1 * 2/2012 Wilfong ..... B65H 16/005 221/30
2012/0305618 A1 * 12/2012 Tan ..... B65H 35/10 225/47

* cited by examiner

--Prior Art--

--Prior Art--

--Prior Art--

--Prior Art--

BAG OPENER COMPONENT FOR PLASTIC BAG DISPENSER

RELATED U.S. APPLICATION DATA

Continuation-in-part of application Ser. No. 14/756,067 filed on Jul. 27, 2015

STATEMENT REGARDING FEDERALLY SPONSORED RESEARCH OR DEVELOPMENT

Not applicable

FIELD OF THE INVENTION

This invention relates generally to devices that are designed to serially dispense plastic bags from a continuous roll, such as the type used for self-service produce, grocery or garbage bags. More specifically, this invention describes an accessory component that may be used to retrofit existing bag dispensers.

BACKGROUND OF THE INVENTION

Bag dispensers are ubiquitous throughout grocery stores and markets where produce and other items are displayed in bulk, and consumers select and bag their own merchandise for purchase. A common form of such dispensers utilizes rolls of bags, standardly referred to as "star-seal" bags, in which a tube of plastic is folded or gusseted to form multiple layers. The long tubes are welded laterally at uniform intervals to form individual bags. The bags are connected sequentially along perforated lines and wound onto a roll. A projection on the dispenser, hereinafter referred to as the tongue, engages a slot in the perforation line to separate a bag from the roll and hold the trailing bag in position for the next user.

A common complaint of users is that, once a bag has been removed, it is difficult to open. This is partially due to the bag material, which has a tendency to build up a static charge causing the thin layers of plastic to adhere to each other. However, it is also a deficiency of current dispenser designs that they do not provide a means for separating the plies as the bags are dispensed.

Multiple dispenser designs have been disclosed in prior art that address a variety of issues related to the utility of bag dispenser devices. Simhaee (U.S. Pat. Nos. 5,135,146, 5,261,585, 5,433,363) describes various features to enable one-handed operation and prevent free-wheeling of the roll during operation. In later designs, Simhaee (U.S. Pat. No. 5,752,666) incorporates an additional mechanism which traps the leading edge of the next bag to prevent dispensing more than one bag at a time. Morris (U.S. Pat. No. 5,556, 019) introduced a design that allows for operation when bags are pulled across the top or bottom of the tongue, and also incorporates a means of providing constant tension on the bags regardless of how many remain on the roll.

Kannankeril (U.S. Pat. No. 5,573,168) discloses a dispenser with a guide slot to ensure more reliable contact between the perforation and the tongue. The invention also discloses a "brush" as a frictional element to assist in opening the bags, however, this mechanism is integrated into an interior panel and is therefore limited to use with the described dispenser design. Kannankeril's design also differs from the present invention in that the frictional element engages the top ply of the bag rather than the bottom ply as disclosed in the present invention. Applying friction to the top ply, as Kannankeril describes, requires the user to pull upward on the bag in order to achieve adequate frictional force to separate the bag plies. This design also applies friction prior to separation of the leading bag from the trailing bag. In order to separate the plies as a bag is dispensed, the frictional element must be positioned such that the friction is applied while the bags are being separated at the perforation line.

Daniels (U.S. Pat. Nos. 7,270,256 and 7,424,963) discloses a bag opening means that is also integrated into the dispenser and thus is limited to use with the described dispenser design. The bag opening means is also designed to facilitate opening of the leading bag as opposed to the trailing bag, as described in the present invention.

Other inventions specifically aimed at facilitating opening of bags as they are dispensed address this issue by modifying the design of the bag itself. Simhaee (U.S. Pat. No. 6,135, 281) describes a method of manufacturing a continuous strip of bags in which one or more outer layers are separated entirely at the perforation line to facilitate easier separation of the bag from the roll. In another invention, Simhaee (U.S. Pat. No. 5,291,390) describes a bag design in which one ply does not contain a slit along the perforation line. The extra force required to detach this ply from the roll causes the plies to separate from each other. Campbell (U.S. Pat. No. 4,904, 092) discloses the use of pressure sensitive adhesive on an outer surface of each bag which causes the front and back to separate when another is pulled from the roll or stack. Finally, Tan (U.S. Pat. No. 8,979,367) discloses features on the outer surface of the bags (either in a roll or in a stack) which releasably attach the rear wall of a first bag to the front wall of a second bag so that when the first bag is removed it causes the second bag to open before releasing. All of these solutions add extra cost to the individual bags, generating ongoing and unnecessary expense for the consumer.

In light of the foregoing discussion, it is an objective of the present invention to provide a means of dispensing plastic bags from a roll such that the bags are presented to the user in a partially opened state, without the need for specially modified bags.

Furthermore, it is an objective of the present invention to do so by providing an inexpensive accessory that can be easily retrofitted to a variety of existing plastic bag roll dispensers without the need for special tools or other apparatus.

SUMMARY OF THE INVENTION

The present invention describes a device that may be fitted to existing plastic bag dispensers—in particular those that utilize rolls of bags standardly referred to as "star seal"—such that when the bags are dispensed they are presented to a user in a partially opened state. The device comprises a length of pliable material (hereinafter referred to as the "flap"), such material having sufficient coefficient of friction so as to exert adequate friction force against the bag to separate the plies and adequate rigidity so as to exert pressure against the bag without puncturing or tearing the outer bag plies.

In a preferred embodiment of this invention, the flap is attached to a bag dispenser by means of a flexible mounting adaptor that conforms to a bag dispenser element, such adaptor comprising material having adequate rigidity so as to be durable and robust.

In another embodiment, the flap is attached to a bag dispenser element by means of a mechanical clip that utilizes spring tension to hold the flap in position.

DETAILED DESCRIPTION OF THE INVENTION

Referring to FIGS. 1-8B, the bag opener component of the present invention includes a friction element and a means of mounting to an existing bag roll dispenser in such a way as to enable bags to be presented in a partially opened state.

Figure 1:
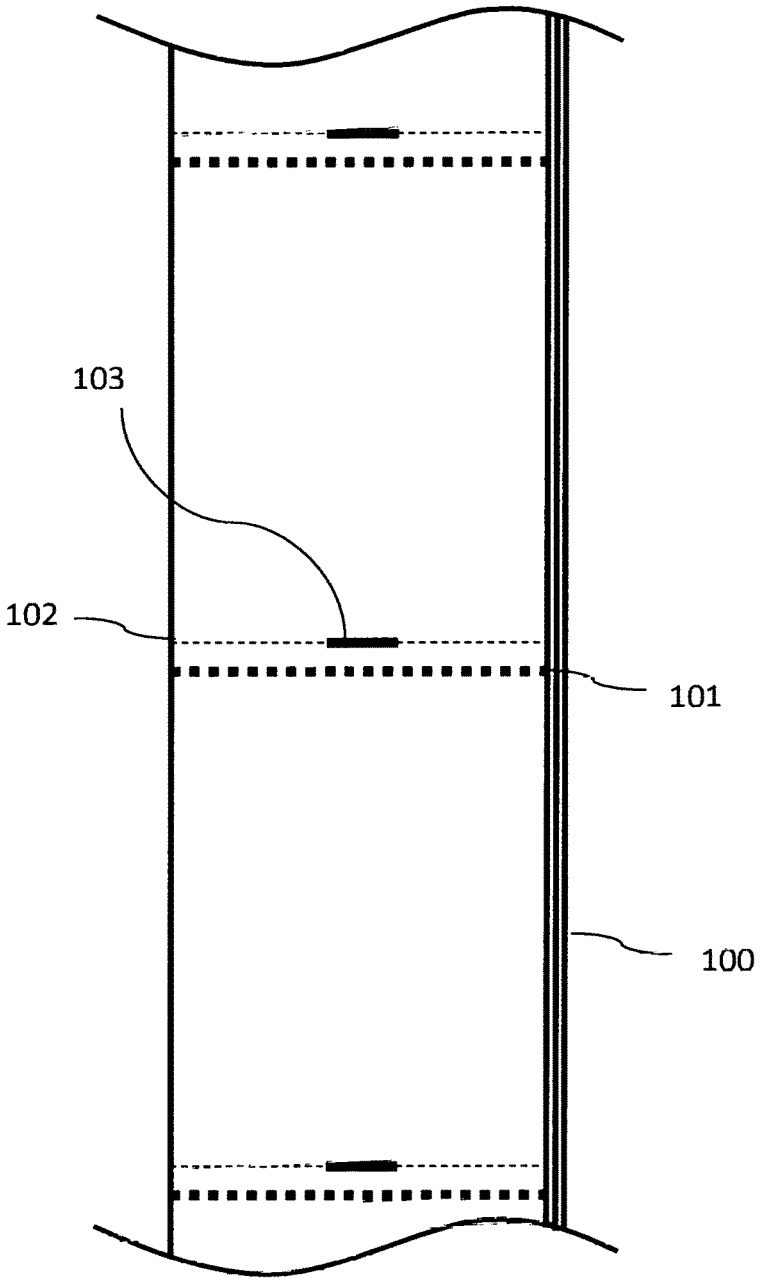
FIG. 1 illustrates typical construction of plastic bags that are dispensed from a continuous roll.

FIG. 1 illustrates a typical bag design of the type standardly referred to as "star seal." The bag 100 is formed from a tube of thin film plastic that is folded or gusseted creating multiple bag plies. Each bag is welded at one end 101 to form the bag bottom and releasably attached to the next bag by means of a perforation line 102. A slot 103 in the perforation line provides an opening to facilitate separation. A continuous strip of bags is wound on a roll for dispensing in a bag dispenser.

Figure 2:
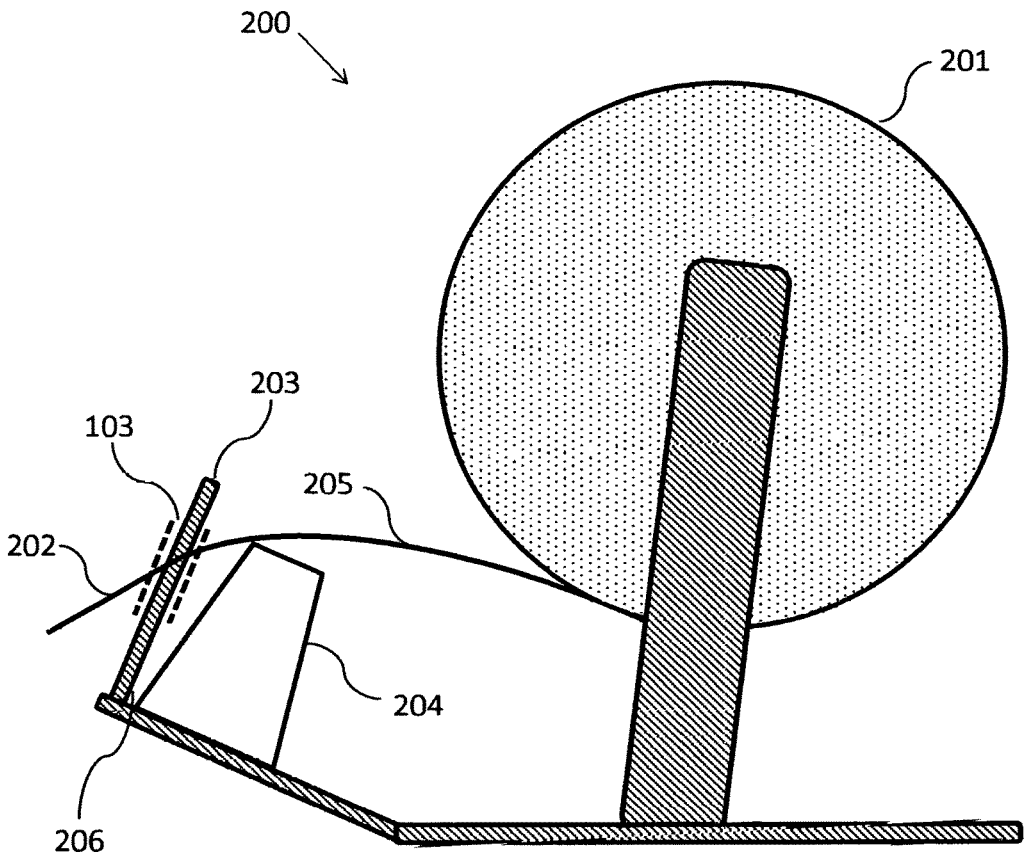
FIG. 2 illustrates a typical bag dispenser.

FIG. 2 is a functional illustration of a typical bag dispenser 200 for a roll of bags 201 constructed as described above. As a single bag 202 is dispensed, a tongue 203 engages a slot 103 in the perforation line between the bag being dispensed 202 and the trailing bag 205. A finger 204 creates a gap 206 which traps the leading edge of the trailing bag 205 and holds it in position for the next user.

Figure 3A:
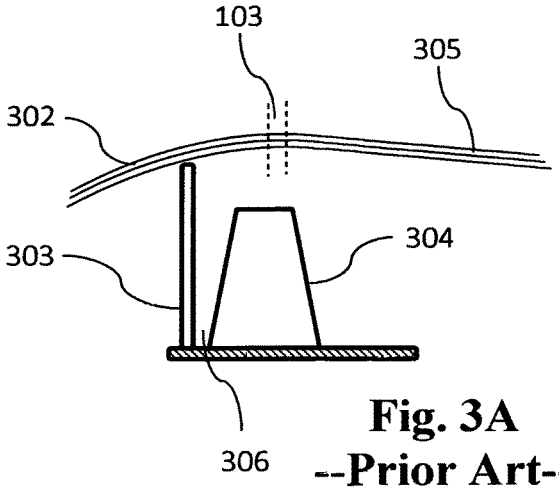
FIGS. 3A, 3B and 3C illustrate the operation of a common type of metal frame bag dispenser.
Figure 3B:
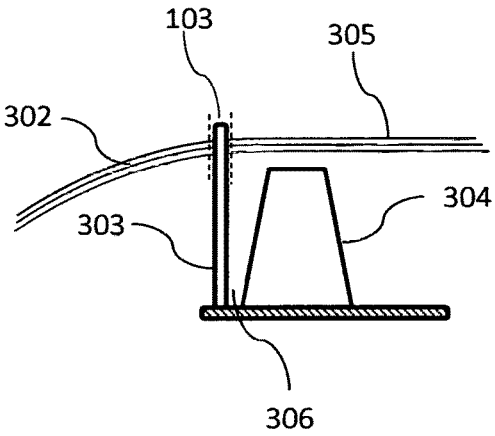
Figure 3C:
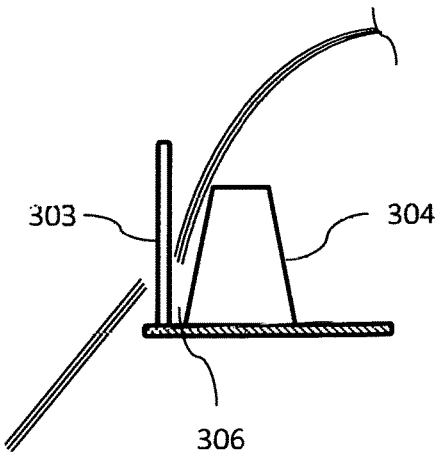

FIGS. 3A, 3B, and 3C, illustrate this action in greater detail for multi-ply bags that would be typical of a star-seal design. As shown in FIG. 3A, as the leading bag 302 is being dispensed, it rides smoothly along the top of the tongue 303. When the tongue 303 engages the slot 103 in the perforation line between the leading bag 302 and the trailing bag 305, as illustrated in FIG. 3B, it limits further travel of the trailing bag 305 and facilitates separation of the two bags along the perforation line. As shown in FIG. 3C, as the bags are being separated, the leading edge of the trailing bag 305 is pulled into the gap 306 that is formed between the tongue 303 and the finger 304. Due to the fact that the finger 304 is a smooth surface, the trailing bag 305 rides smoothly over the surface and the bag plies do not separate.

Figure 4A:
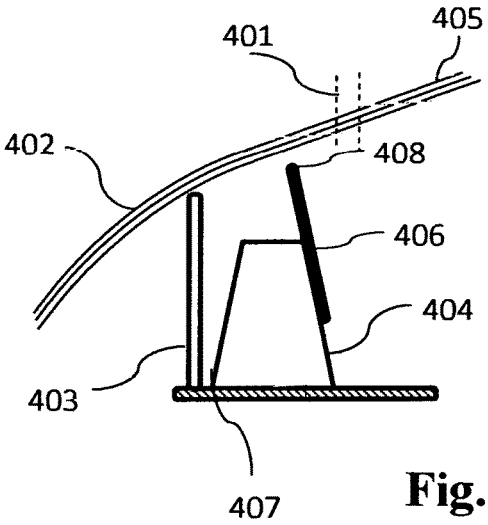
FIGS. 4A, 4B and 4C illustrate the operation of a common type of metal frame bag dispenser with a preferred embodiment of the present invention attached.
Figure 4B:
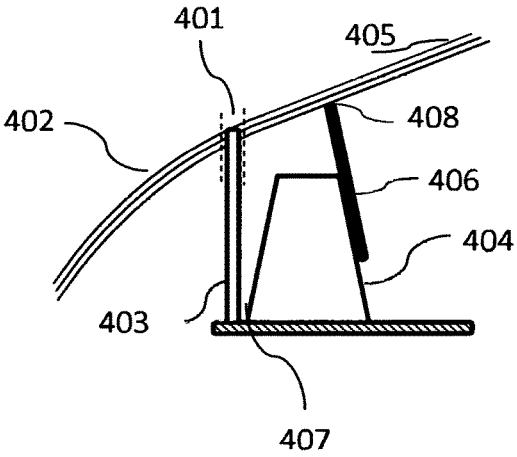
Figure 4C:
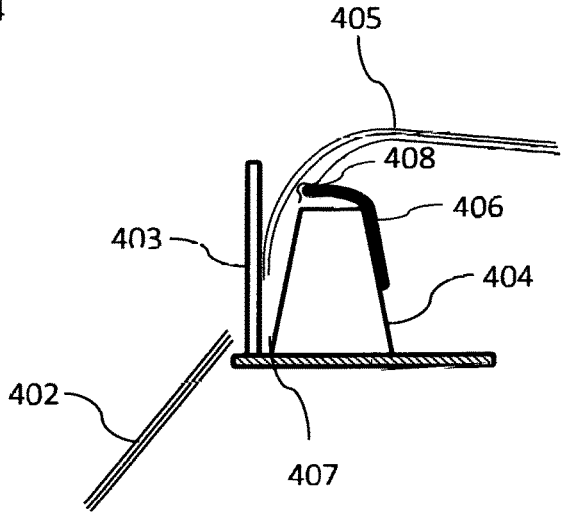

FIGS. 4A, 4B and 4C illustrate the action of a typical bag dispenser with the bag opener flap 406 of the present invention attached to the finger 404 of a typical dispenser. As shown in FIG. 4A, as the leading bag 402 is being dispensed, it rides smoothly along the top of the tongue 403. When the dispenser tongue engages the slot 401 in the perforation line between the leading bag 402 and the trailing bag 405, as illustrated in FIG. 4B, it limits further travel of the trailing bag 405 and facilitates separation of the two bags along the perforation line. However, in this case, the trailing bag 405 encounters the flap 406 of the bag opener of the present invention. As shown in FIG. 4C, as the bags are being separated, and the leading edge of the trailing bag 405 is pulled into the gap 407 that is formed between the tongue 403 and the finger 404, the flap bows forward while remaining in contact with the bottom ply of the trailing bag 405. The friction applied against the bottom ply of the trailing bag 405 causes the plies to separate, leaving the trailing bag 405 in a partially opened state for the next user.

The flap 406 must have sufficient length such that is extends slightly above the highest point of the dispenser tongue 403, yet allows bags to travel freely until the point at which the tongue 403 engages the slot 401 between the leading bag 402 and the trailing bag 405. In addition, the flap 406 should be positioned such that when the flap 406 is fully bowed, the top edge of the flap 406 is substantially aligned with the front surface of the finger 404 so as not to interfere with the gap which is required for proper functioning of the dispenser. The flap 406 material is selected to provide adequate frictional force to separate the lower bag ply from the upper bag plies. Materials that possess suitable coefficient of friction include but are not limited to silicone, natural rubber, polyethylene and polyurethane.

Mounting Options

Figure 5:
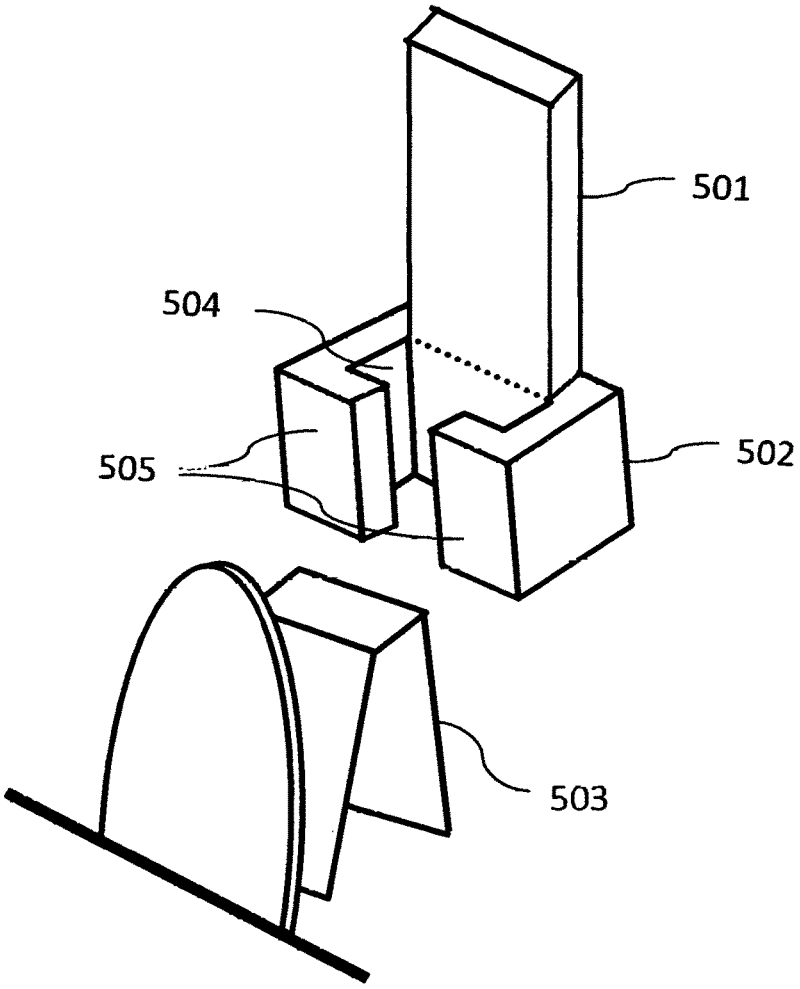
FIG. 5 is an exploded view of a preferred embodiment of the present invention and the dispenser component to which it attaches.

FIG. 5 is an exploded view of a preferred embodiment of the present invention designed for use on dispensers having a finger 503 that is open on both sides, such as a metal frame bag dispenser. The bag opener component is constructed in two pieces, namely the flap 501 and the mounting adaptor 502. The mounting adaptor 502 is positioned such that it rides against the underside of the finger 503. In this way, the vertical extension of the flap 501 may be controlled. The flexible mounting adaptor 502 material must be sufficiently pliable to conform to the finger element of the dispenser, while having adequate wall strength to hold it securely in position. Materials that possess suitable durometer and wall strength include but are not limited to silicone, natural rubber, polyethylene and polyurethane.

The flap 501 may be attached to the flexible mounting adaptor 502 using adhesive methods appropriate to the materials selected, including but not limited to gluing, cementing and hot welding. Alternatively, the flap 501 and flexible mounting adaptor 502 may be injection molded as a single device.

The dimensions of the aperture 504 formed by two flanges 505 located on opposite sides of the mounting adaptor 502 is determined by the width and thickness of the finger 503 material. The pliability of the component material allows the mounting adaptor 502 to be stretched over the back surface of the finger 503. The flanges 505 serve to hold the mounting adaptor 502 securely in place.

Figure 6:
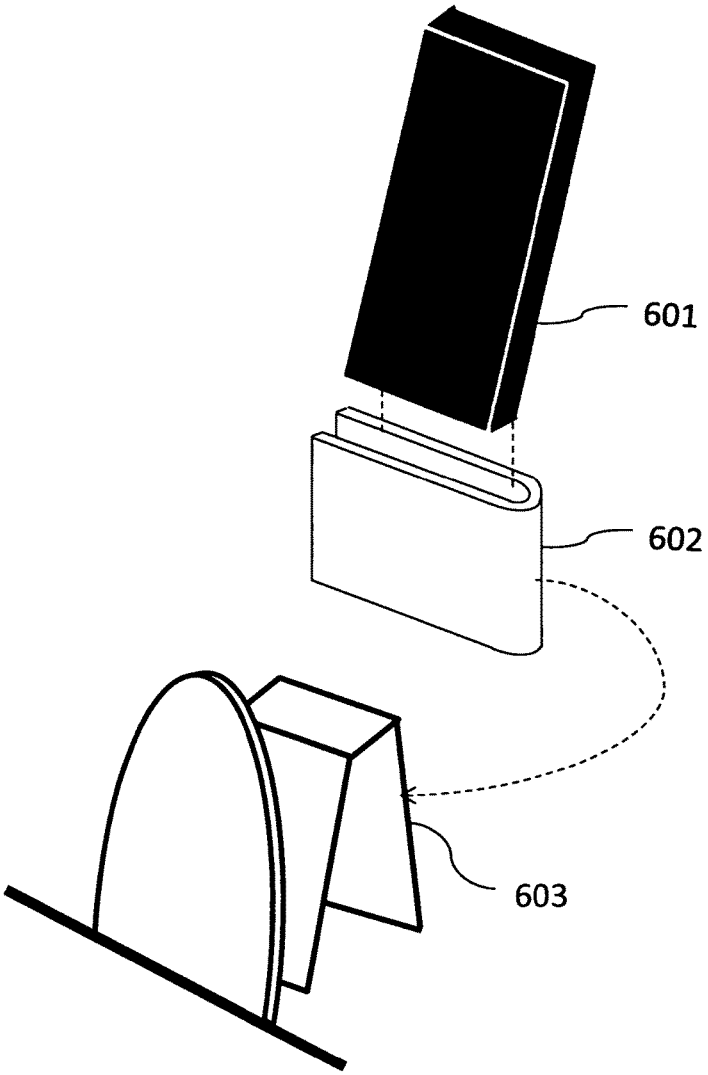
FIG. 6 illustrates another embodiment of the present invention attached to a typical metal frame bag dispenser using a mechanical clip.

FIG. 6 illustrates another embodiment of the present invention in which the flap 601 is designed to be attached to a dispenser having a finger 603 that is open on both sides using a mechanical clip 602. The flap 601 material is selected to provide adequate frictional force to separate the lower bag ply from the upper bag plies. Materials that possess suitable coefficient of friction include but are not limited to silicone, natural rubber, polyethylene and polyurethane. The clip 602 material is selected to have sufficient spring force to be held in place on the finger 603 solely by mechanical spring tension. The clip 602 is positioned such that it rides against the underside of the finger 603. In this way, the vertical extension of the flap 601 may be controlled.

Other Design Considerations

Figure 7A:
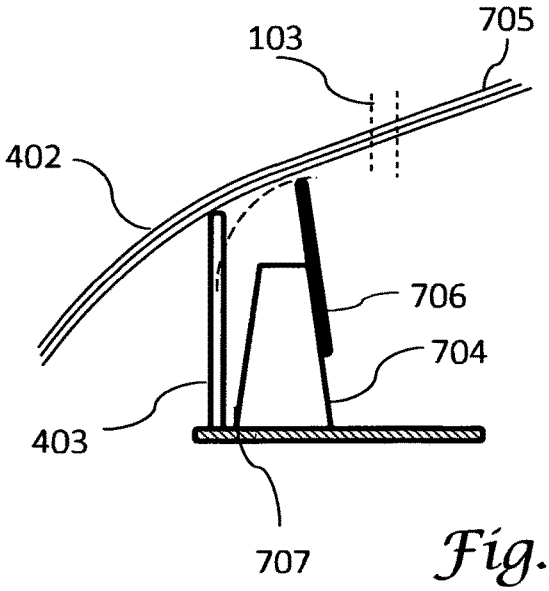
FIGS. 7A and 7B illustrate a possible modification of the present invention to accommodate a potential variation in the dispenser design.
Figure 7B:
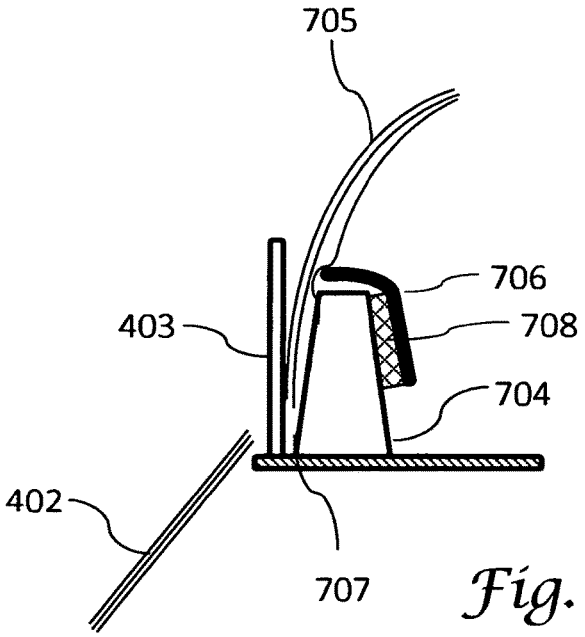

In order to accommodate diverse dispenser designs, specific parameters of the flap and/or mounting adaptor may be adjusted to compensate for dimensional variations. For example, FIGS. 7A and 7B illustrate a dispenser in which the horizontal depth of the finger 704 is relatively shallow. As shown in FIG. 7A, adjusting the length of the flap 706 solely for proper vertical extension of the flap results in the flap interfering with the gap 707 required for proper operation of the dispenser when the flap 706 is bowed. In this case, as illustrated in FIG. 7B, a spacer 708 between the back surface of the finger 704 and the front surface of the flap 706 preserves the required vertical extension while limiting the horizontal extension of the flap, enabling proper operation of the bag dispenser.

Figure 8A:
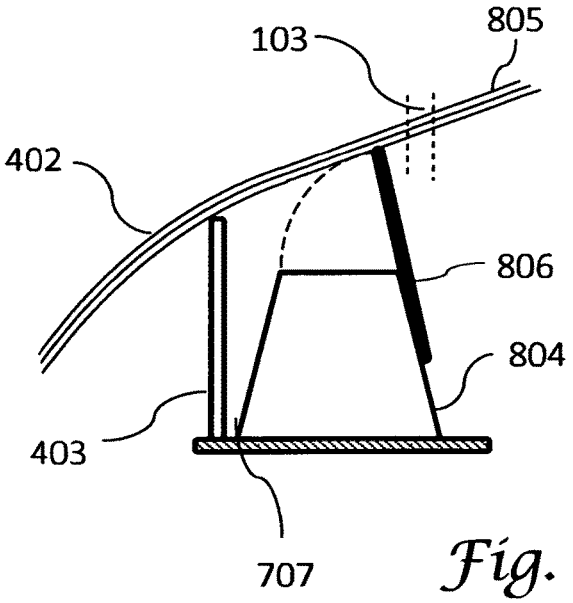
FIGS. 8A and 8B illustrate a possible modification of the present invention to accommodate a second potential variation in the dispenser design.
Figure 8B:
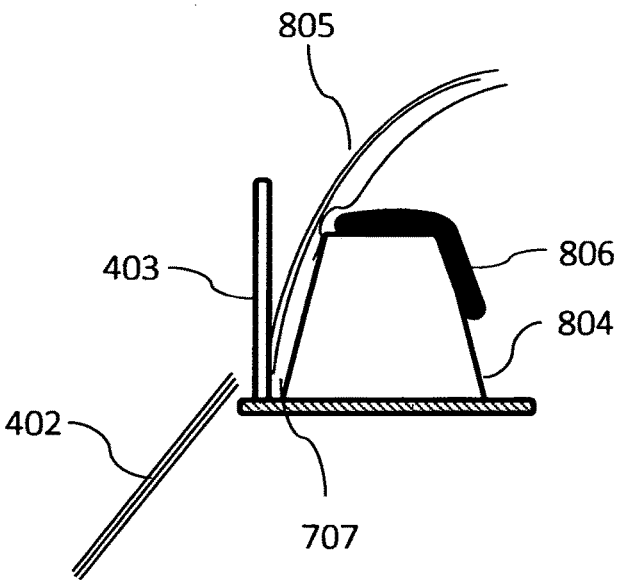

FIGS. 8A and 8B illustrate a dispenser in which the horizontal depth of the finger 804 is relatively long. As shown in FIG. 8A, adjusting the length of the flap 806 solely for proper horizontal extension when the flap is bowed results in the flap interfering with the travel of the leading bags 802 when the flap 806 is vertically extended. In this case, the thickness of the flap 806 must be increased to ensure contact with the bottom ply of the trailing bag 805 when the flap is bowed, as illustrated in FIG. 8B.

As described herein, the present invention provides an accessory and adaptor for existing bag roll dispensers that enables plastic bags to be dispensed from a roll in a partially opened state.

The foregoing description was primarily directed to a preferred embodiment of the invention. It is anticipated that one skilled in the art will likely realize additional alternatives that are now apparent from disclosure of the embodiments of the invention.

What is claimed:

1. An accessory component for retrofitting a bag roll dispenser to facilitate the dispensing of bags formed from a continuous roll in a partially opened state, the bags are multiply multi-ply bags comprising a top ply and a bottom ply, the bag roll dispenser comprising:

a tongue configured to separate a bag from the roll and a finger comprising a front wall facing the tongue and a rear wall opposed to the front wall, the walls are separated by openings on opposing sides of the finger, and the tongue and the finger are separated by a gap, wherein the accessory component comprises an elongated flap which is constructed from a pliable, friction inducing material, wherein said friction inducing material provides sufficient resistance to the bottom ply of the multi-ply bag in order to separate the plies as a bag is dispensed and a mounting adaptor that comprises at least one front wall and a rear wall separated by an aperture;

wherein the mounting adaptor attaches to the finger by means of the aperture, wherein the aperture is sized to match the openings on opposing sides of the finger;

wherein the flap extends in a substantially vertical direction and is secured in the aperture between the rear wall of the finger and the rear wall of the mounting adaptor and a top end of the flap would be in contact with the bottom ply of the bag exerting friction to the bottom ply so the bottom ply separates from the top ply.

2. The accessory component of claim 1 wherein the friction inducing material is one of silicone, rubber, polyethylene or polyurethane.

3. The accessory component of claim 1 wherein the mounting adaptor comprises a flexible adaptor with at least 3 walls.

4. The accessory component of claim 1 wherein the mounting adaptor comprises a mechanical clip.

5. The accessory component of claim 1 wherein the vertical extension of the flap can be adjusted while being secured to the mounting adaptor.

6. The accessory component of claim 1 also comprises a spacer between the rear wall of the finger and a front surface of the flap to increase a horizontal separation between the flap and the tongue.

* * * * *